US005372372A

United States Patent [19]

Wood

[11] Patent Number: 5,372,372

[45] Date of Patent: Dec. 13, 1994

[54] METHOD OF TYING STEEL INCLUDING SUPPORTING THE WORKER UPON A CART

[76] Inventor: Timothy Wood, 6000 N. Wagon Trail Rd., Columbia, Mo. 65202

[21] Appl. No.: 189,491

[22] Filed: Jan. 31, 1994

Related U.S. Application Data

[63] Continuation of Ser. No. 919,360, Jul. 23, 1992, abandoned.

[51] Int. Cl.[5] ..... B25H 5/00

[52] U.S. Cl. ..... 280/32.5; 280/651; 280/79.2; 52/741.1; 104/307; 404/100

[58] Field of Search ..... 280/32, 32.5, 32.6, 280/639, 651, 79.2, 87.021, 87.05, 23.1, 32.7; 52/741.1, 745.21, 749; 104/307; 404/100, 128, 135, 136

[56] References Cited

U.S. PATENT DOCUMENTS

| | | | |
|---|---|---|---|
| 247,356 | 10/1881 | Taylor . | |
| 399,248 | 3/1989 | Deming . | |
| 667,370 | 2/1901 | Sowder . | |
| 1,038,137 | 9/1912 | Hickey . | |
| 1,402,649 | 1/1922 | Phelps et al. . | |
| 2,069,476 | 2/1937 | Keil . | |
| 2,148,199 | 2/1939 | Heckman . | |
| 2,424,032 | 7/1947 | Henderson . | |
| 2,595,784 | 5/1952 | Griffin et al. . | |
| 2,699,953 | 1/1955 | Chaddick . | |
| 2,825,273 | 3/1958 | Faucheux . | |
| 3,361,043 | 1/1968 | Beeson | 404/100 |
| 3,361,224 | 1/1968 | McKim . | |
| 3,614,120 | 10/1971 | Cicero . | |
| 3,814,144 | 6/1974 | Spencer | 404/100 X |
| 3,976,155 | 8/1976 | Esch . | |
| 4,632,410 | 12/1986 | Bainbridge et al. . | |
| 5,184,446 | 2/1993 | Gustavsen | 52/749 X |

FOREIGN PATENT DOCUMENTS

| | | |
|---|---|---|
| 127420 | 4/1948 | Australia . |
| 239139 | 9/1925 | United Kingdom . |

*Primary Examiner*—Brian L. Johnson

*Attorney, Agent, or Firm*—Kokjer, Kircher, Bowman & Johnson

[57] ABSTRACT

A cart and a method of using the cart for tying steel rods, which cart includes a substantially rectangular frame supporting front and rear rollers. The rollers are in the form of cylinders having a substantial width which is much greater than the largest anticipated spacing between parallel reinforcement rods. The use of the cylinders as rollers allows the cart to travel upon the uppermost layer or set of reinforcing rods without becoming entangled in the lattice of reinforcing rods. A cushioned seat may be located on the frame adjacent an open area extending through the frame. The worker may support herself or himself upon this cushioned portion while the open area provides access to the lattice for tying the rods together. Vertical bars may support an alternate cushion at a position spaced upwardly from the reinforcing rods. The user may then rest his or her stomach or chest upon this upper cushion and lie in a faced down configuration with the reinforcing rods at arms length. Additional vertical rods and a further cushion may be provided as a forehead rest to prevent neck strain in this position.

20 Claims, 2 Drawing Sheets

METHOD OF TYING STEEL INCLUDING SUPPORTING THE WORKER UPON A CART

CROSS REFERENCE TO RELATED APPLICATIONS

This application is a continuation of application Ser. No. 07/919,360 filed Jul. 23, 1992, now abandoned.

BACKGROUND OF THE INVENTION

1. Field of the Invention

The present invention relates in general to apparatus used in the construction of reinforced concrete structures. In particular, the present invention relates to an improved device for supporting a worker during the tying or joining of reinforcement rods for concrete structures.

2. Description of the Related Art

When forming a reinforced concrete structure it is common to form a lattice of steel reinforcement rods about which tile concrete is poured or cast. To maintain the structural integrity of the lattice prior to and during the pouring of the concrete, the reinforcement rods are tied together at their intersections by lengths wire or plastic ties.

Where the structure takes the form of a floor, roadway, bridge or other slab type structure, the reinforcing lattice typically takes the form of a horizontal plane formed by a first lower set of laterally spaced reinforcement rods extending in a first direction, and a second upper set of laterally spaced reinforcement rods extending in a perpendicular direction. Where this is the case, the tying of the steel has been an uncomfortable task.

In particular, the expanse of such slabs typically necessitates that the workers support themselves upon the lattice of reinforcing rods during the application of the ties, requiring them to sit or kneel upon the lattice. This is quit uncomfortable due to the relatively large spacing of the lattice and the rigid nature and small diameter of the reinforcing rods. Some workers have rested their buttocks or knees upon sheet material such as plywood, providing some relief, but necessitating movement of the sheet material at frequent intervals. Even with this sheet material, the worker must bend over to tie the steel, resulting in back fatigue and possibly injury.

SUMMARY OF THE INVENTION

It is an object of the present invention to provide a device which will increase the comfort of workers while performing the method of tying steel to form reinforced concrete slabs.

It is another object of the present invention to provide such a device that will enable a worker to assume a position in which back strain is greatly reduced.

Yet another object of the present invention is to provide such a device which may be easily moved over the lattice of reinforcing rods.

Yet a further object of the present invention is to provide such a device which is readily adjustable to the preference of a particular worker.

These and other objects are achieved by a cart for tying steel which includes a substantially rectangular frame supporting front and rear rollers. The rollers are in the form of cylinders having a substantial width which is much greater than the largest anticipated spacing between parallel reinforcement rods. The use of the cylinders as rollers allows the cart to travel upon the uppermost layer or set of reinforcing rods without becoming entangled in the lattice of reinforcing rods. A cushioned seat may be located on the frame adjacent an open area extending through the frame. The worker may support herself or himself upon this cushioned portion while the open area provides access to the lattice for tying the rods together. Vertical bars may support an alternate cushion at a position spaced upwardly from the reinforcing rods. The user may then rest his or her stomach or chest upon this upper cushion and lie in a faced down configuration with the reinforcing rods at arms length. Additional vertical rods and a further cushion may be provided as a forehead rest to prevent neck strain in this position.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
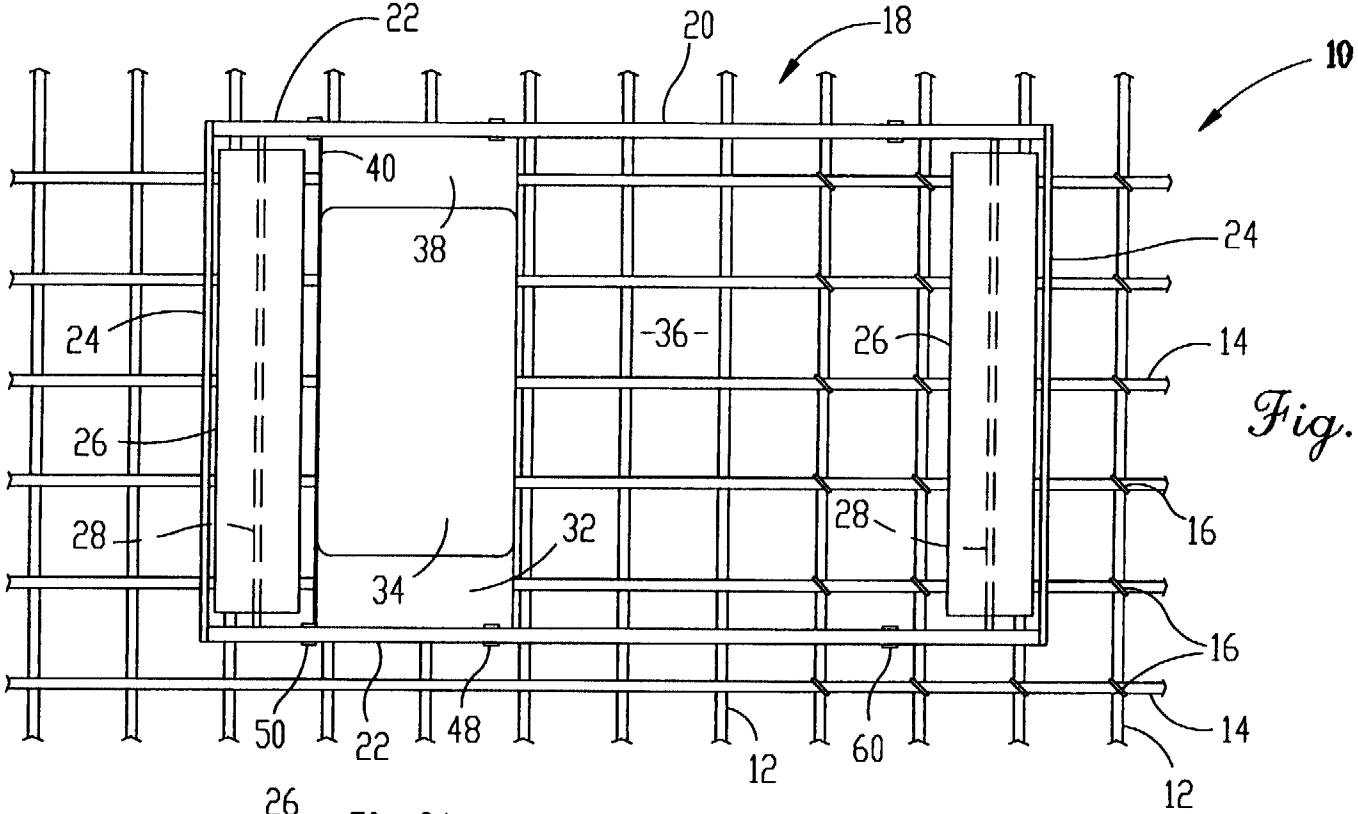
FIG. 1 is a plan view of a cart according to the present invention shown resting upon a lattice of steel reinforcing rods.
Figure 2:
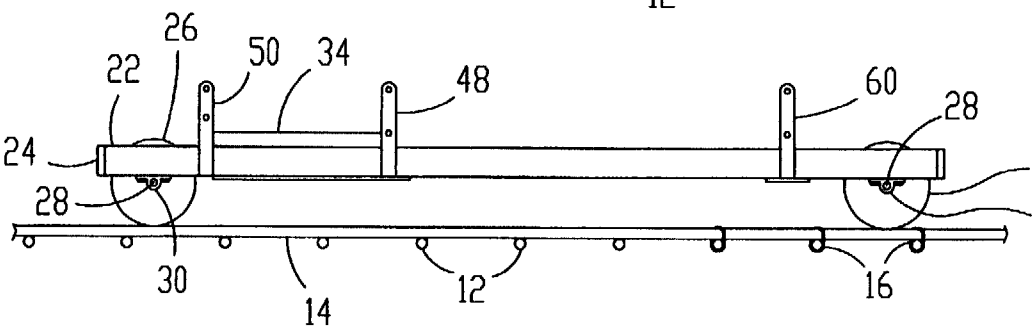
FIG. 2 is a side view of the cart of FIG. 1.

With reference to FIGS. 1 and 2, a lattice of steel reinforcing rods, with which the cart of the present invention is intended to be used, is generally designated by reference numeral 10. The lattice 10 defines a generally horizontal plane, and includes a first set of rods 12 which are laterally spaced by a rod distance and extend substantially parallel in a first direction, and a second set of rods 14, also laterally spaced in a rod distance and extending substantially parallel in a second direction perpendicular to the first direction. As is best shown in FIG. 2, the second set of rods 14 overlie the first set.

The particular size of the rods 12 and 14, along with the spacing of each set, will vary with the particular application and job. To maintain the rods 12 and 14 in the desired lattice configuration, it is known to fix the rods together by ties 16 at the intersections between the first and second rods.

The lattice 10 is intended to support a cart according to the present invention, generally designated by reference numeral 18. The cart 18 includes a frame 20 having a generally rectangular shape and comprised of side members 22 and front and rear members 24. The front and rear members are each fixed to the side members to maintain the side members in their spaced, substantially parallel configuration. The frame 20 is preferably formed of a rigid yet lightweight material, such as aluminum.

Extending between the side members 22 adjacent their ends, and thus adjacent the members 24, are rollers 26. In particular, an axle 28 extends between axle brackets 30 fixed to the side members 22, with the axle 28 serving to support the rollers 26 for rotational movement about an axis.

In general, each of the rollers 26 includes at least one roller segment having a longitudinal length in the direction of its rotational axis which is greater than the lateral spacing of the upper or second set of rods 14, such that the outer cylindrical periphery of each roller segment will contact the upper peripheral portion of at least two of the rods 14. This will help to ensure stability of the cart 18 against tipping. As a practical matter, it is preferred that the roller segment or segments be formed to eliminate the possibility that either or both of the rollers 26 is supported only by a single rod 14. This situation could occur where a single roller segment is employed which has a spacing only slightly greater than the lateral spacing of the rods 14, and a single rod 14 is centrally located within this roller segment, such that the lateral ends are located intermediate adjacent ones of the rods 14.

To eliminate this possibility, two laterally spaced roller segments, each having a spacing greater than the greatest anticipated lateral spacing of the rods 14 could be employed. However, to provide the utmost assurance against such tipping of the cart, it is most preferred to provide a single roller segment, comprising the entire roller 26, which has a longitudinal length which is greater than, and preferably substantially greater than twice the largest anticipated lateral spacing of the rods 14. For example, as shown in FIG. 1, the rollers 26 each have a longitudinal length which is slightly greater than four times the spacing of the rods 14.

The typically circular cross section of the rods 14 will result in each of the rods 14 imparting a point load upon the rollers 26, and for this reason the rollers are preferably formed of a substantially rugged material, such as polyethylene. Additionally, while a relatively resilient outer covering, such as a soft rubber could be employed to reduce lateral slipping of the cart 18, it is preferred that the outer surface be substantially rigid to allow such lateral movement with relatively little effort on the part of the worker, to permitting the cart 18 to be easily shifted to a new work position.

Typically, however, in use the cart 18 will travel in a direction substantially perpendicular to the longitudinal axes of the rollers 26, and in the longitudinal direction of the supporting rods 14. This movement will be effected by the rotation of the rollers 26 with, or about, the associated axles 28. To reduce the weight of the cart 18, the rollers 26 could be formed of substantially tubular members having two or more disc elements located therein to fix the position of the tubular elements with respect to the axle 28. As may be readily envisioned, appropriate bushings or bearings could be provided either between such disc elements and the axle, or between the axle and the axle brackets 30.

With this tubular roller arrangement it may be readily seen that there is no risk of the rollers falling between the rods 14 or 12, thus allowing an easy and safe rolling motion of the cart, thus providing a worker with a method of tying steel rods while supported thereabove.

The cart 18 according to the present invention also includes various elements to support the worker upon the cart. A first of these elements is illustrated in FIGS. 1 and 2, and consists of a seat support plate 32, in the form of a planar element extending between the side members 22 adjacent one of the rollers 26, and a seat cushion 34 resting upon the support plate 32. The support plate 32 may be formed of an aluminum plate welded or bolted into position, and the seat cushion 34 is preferably formed of a resilient foam material having a rugged outer covering, and may be removable from the support plate 32 for cleaning or replacement.

The support plate preferably has a length, in the direction of rolling travel of the cart, which is substantially less than the distance between the rollers 26. This relatively small length, combined with the location of the plate adjacent one of the rollers 26, will define a substantially open area, surrounded by the support plate 32, portions of the side members 22, and the remaining roller 26, through which the worker may readily access the rods 12 and 14 to apply the ties 16. In particular, the worker may take a position seated upon the cushion 34 with his or her back towards the adjacent roller 26 and the worker's feet located within the open work area 36. The worker is thus able to bend or stoop over towards his or her feet to apply the ties to the rods.

By this arrangement the worker will be seated upon a relatively comfortable cushion 34, rather than upon the uncomfortable rods 12 and 14, and may readily push with her or his legs to cause the cart 18 to move in the longitudinal direction of the upper set of rods 14. To provide further convenience for the worker, the cushion 34 may have a lateral dimension smaller than that of the support plate 32, such that at least one of the lateral edges of the cushion 34 is spaced from an adjacent one of the side members 22. This will define an uncovered portion of the support plate between the cushion and side member which may be employed as a tie or tool storage area 38. To reduce the possibility that ties 16 or tools located on the storage area 38 are inadvertently knocked off this area by the worker, there may be provided an upstanding back wall 40 extending across the longitudinal end of the support plate 32 between the side members 22 and adjacent the closest roller 26.

Figure 4:
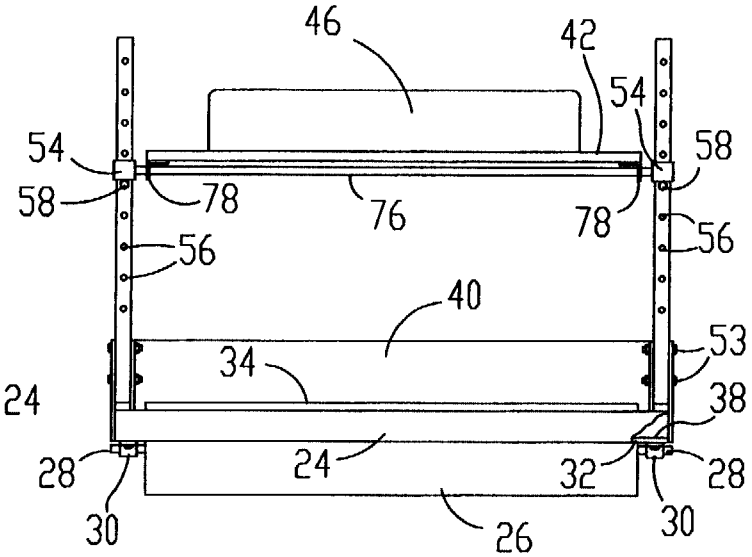
FIG. 4 is a rear view of the cart of FIG. 3.
Figure 3:
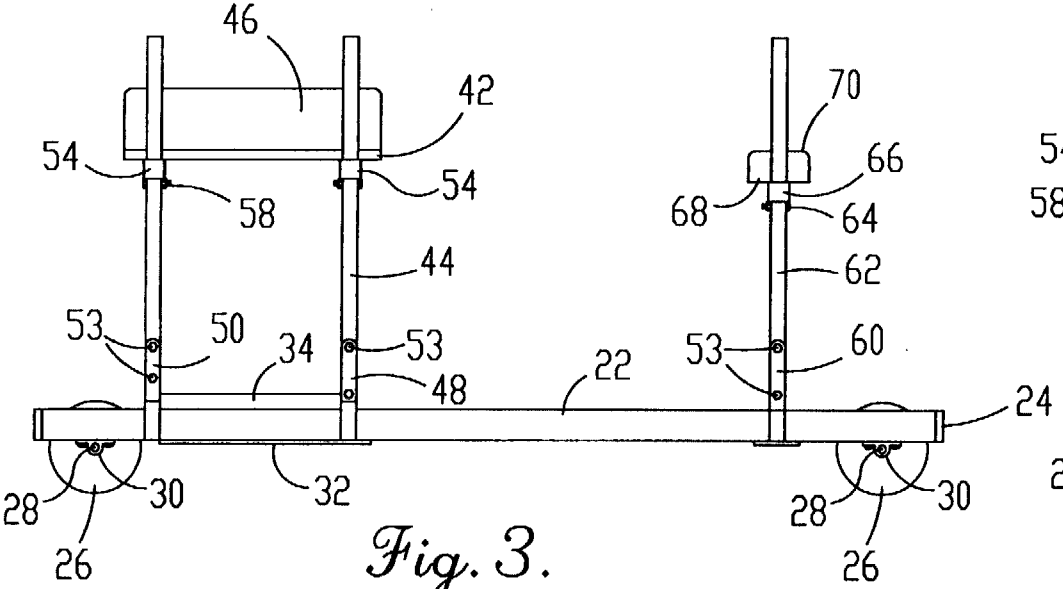
FIG. 3 is a side view of a cart according to the present invention having additional support elements mounted thereon.

Further elements for supporting the worker upon the cart 18 are shown in FIGS. 3 and 4. In particular, a second element to support the worker includes a trunk support having a trunk support plate 42 vertically spaced from the frame 20 by one or more trunk risers 44, and supporting a trunk cushion 46. The frame 20 includes a pair of forward trunk brackets 48 and a pair of rearward trunk brackets 50, with one element of each pair extending upward from an associated one of the side members 22. The trunk brackets are preferably located adjacent the forward and rearward ends, respectively, of the seat support plate 32, with each bracket including a pair of vertically spaced mounting holes 52. One of the trunk risers 44 is associated with each of the brackets 48 and 50 and is fixed thereto by pins or bolts to extend upward from the frame 20. The trunk support plate 42 is then fixed to the trunk risers 44 by appropriate plate brackets 54.

In a preferred arrangement the plate brackets may take the form of collars which slide upon the associated risers 44 and may be releasably fixed thereto, at least with respect to downward movement, at various vertical positions. For example, each of the risers 44 may include a plurality of vertically spaced adjustment holes 56 extending therethrough. Adjustment pins or bolts 58 may be inserted through the holes 56 at an appropriate location in each of the risers 44 such that the plate brackets 54 will rest upon the pins 58 to prevent downward movement of the support plate 42 and cushion 46, thus allowing the user to rest his or her weight thereon. The cushion 46, like the seat cushion 34 is preferably formed of a resilient foam or similar material having a rugged exterior covering, and is preferably removable for cleaning and replacement.

The trunk cushion 46 is intended to receive the abdominal portion of the worker, with the worker in a face down position with the head and shoulders located above the work area 36. The use of adjustment holes 56 and adjustment pins 58 allows the worker to place the trunk cushion 46 at an appropriate vertical height such that the rods 12 and 14 may be easily reached to apply the ties 16. The worker's legs will hang downward behind the cart 18 when using the trunk cushion 46, allowing the workers feet to engage the rods 12 and 14 to thus move the cart 18 in the longitudinal direction of the upper set of rods 14. It is noted that in this position the user will not be in a stooped configuration, thus relieving a certain amount of back strain, and that the storage area 38 formed on the seat support plate 32 is still accessible to the worker.

The support plate 42 and cushion 46 may be modified with additional segments to provide additional comfort to the user. For example, the cushion 46 and plate 42 could extend slightly forward of the position shown in FIG. 3, to provide the user with support in the chest area, thus further eliminating back strain. The plate and cushion could also include a knee support and cushion spaced below and towards the rear of the cushion 46 such that the user may engage the knee cushion with the shin portion of the legs and the cushion 46 with the abdominal portion, placing the worker in a kneeling position. This would allow the user to occasionally remove the weight of the body from the cushion 46, placing additional weight upon his or her knees, to reduce fatigue and ease breathing.

A third element to support the user during use of the cart may take the form of a head rest intended to be used in conjunction either the seat cushion 34 or with the trunk cushion 46. In a manner similar to the trunk support, the head support may include a pair of head support brackets 60, with one of the brackets extending upward from each of the side members 22 at a position forward of the trunk cushion 46. Each of the support brackets 60 will mount a vertically extending head support riser 62 having a plurality of vertically spaced adjustment holes. The adjustment holes may receive an adjustment pin or bolt 64 which will prevent downward movement of an adjustment collar 66 mounted for sliding movement on each of the risers 62. Fixed between the collars 66 is a head support plate 68 upon which is mounted a head support cushion 70 adapted to engage a forehead of the worker when the worker's abdomen is resting upon the cushion 46. The cushion 70 is similar to those other cushions described above.

The provision of the adjustment pins and collars on the head support provide vertical adjustment to suit the individual taste of a particular worker, and it is also preferred that the support brackets 60 are adjustable on the associated side members 22 in the direction of travel of the cart 18 to allow for workers of different height. This adjustment in the direction of travel may be achieved by providing a plurality of holes in each of the side members 22 and fixing the brackets 60 by bolts extending through such holes, or by clamping the brackets in position on the side members.

As may be readily envisioned, the use of the head support in conjunction with the trunk support will provide additional comfort for the worker by supporting his or her head and thus reducing neck strain.

Figure 5:
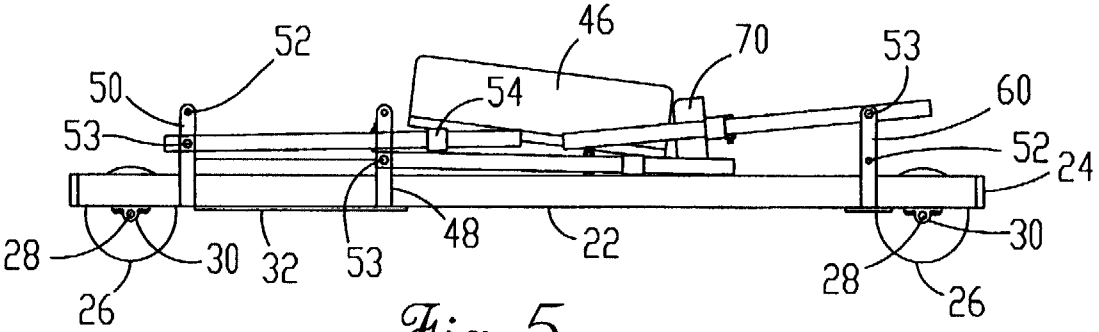
FIG. 5 is a side view of the cart of FIG. 3 showing a disassembled condition for transport.

To assist in storage and transport of the cart 18, it is preferred that the trunk and head supports may be moved from the operative positions shown in FIGS. 3 and 4 to a storage position, shown in FIG. 5, while still remaining associated with the frame 20. This arrangement may be effected by forming the connection between each of the brackets 48, 50 and 60 and the associated risers 44 and 62, respectively as the pair of vertically spaced mounting holes extending through each associated riser, and removably fixing the bolt or pin 53 through each of the holes 52. By this arrangement the provision of two vertically spaced mounting pins or bolts will prevent relative rotation between the brackets and risers, thus assuring that the risers will be maintained in a vertical position, yet removal of one of the pins 53 from each of the brackets will allow the associated riser to pivot about the remaining mounting pin to a position substantially parallel to the side members 22.

As is best illustrated in FIG. 5, forming the lowermost mounting holes 52 in the forward trunk brackets 48 at a position vertically below that of the lower mounting holes 52 in the rearward trunk brackets 50 will allow the rearward risers 44, when pivoted to the storage position about these lowermost holes 52, to attain a more parallel relationship above the forward risers and thus reduce the vertical height of the cart in the storage position. A similar arrangement could be employed with the mounting holes 52 in the head support brackets 60, although it is sufficient to merely pivot the head support riser 62 about the upper one of the mounting holes 72, as shown in FIG. 5.

As may be envisioned, the trunk plate brackets 54 will attempt to rotate with the trunk risers 44 during movement between the operative and storage positions. Where these brackets 54 are fixed to the trunk support plate 42, such rotation will be prevented, requiring the support plate 42 to be removed from the risers 44 prior to pivoting to the storage position. To prevent the need for such removal and thus improve the convenience of the cart 18, the trunk support plate 42 may be connected to the plate brackets 54 by joints which allow rotation. For example, a pivot rod 76 may extend between each of the forward pair and rearward pair of the brackets 54, with the plate 42 having downward extending pivot brackets 78 through which the associated pivot rods are pivotally received. This arrangement will allow the plate 42 and cushion 46 to remain associated with the risers during all positions between and including the operative and storage positions, with the plate and cushion assuming a position substantially as that shown in FIG. 5 when stored.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. In a method of tying steel rods having at least a first lower set of said rods in spaced substantially parallel relation, and a second upper set of said rods in substantially parallel relation and spaced by a bar distance, said first and second sets of rods extending at an angle with respect to each other to define a substantially planar lattice, said method including manually connecting a rod of said first set to a rod of said second set at a position at which said rods intersect, the improvement comprising:

providing a cart for supporting a worker, said cart comprising a frame having a front end and a rear end aligned in a longitudinal direction;

at least one support element mounted upon said frame and adapted to support a portion of the worker using said cart;

front and rear rollers mounted to said frame adjacent said front and rear ends, respectively, for rotation with respect thereto about horizontal axes substantially perpendicular to the longitudinal direction, each of said rollers being defined by at least one roller segment having a substantially tubular outer surface adapted to be supported upon one or more of the rods and having a length greater than the bar distance;

placing said cart upon said second set of rods with said longitudinal direction substantially aligned with the longitudinal axis of said rods of said second set; and supporting a worker upon said cart, with said support element, during said manual connecting of said rods and during movement of said cart, by movement of said rollers over said second set of said rods, between locations for effecting said manual connecting of said rods.

2. The improvement of claim 1, wherein said providing step further comprises said length of said roller segment being substantially greater than twice the bar distance.

3. The improvement of claim 1, wherein said providing step further comprises said support element being spaced from said front roller, and said support, front roller and frame defining an open area extending through said frame allowing access to the bars below the cart, said worker manually engaging the bars through said opening.

4. The improvement of claim 3, wherein said providing step further comprises said length of said roller segment being substantially greater than twice the bar distance.

5. The improvement of claim 3, wherein said providing step further comprises said support including a seat support plate extending laterally across said frame and a seat cushion mounted upon said support plate, said seat cushion having a lateral length less than that of said support plate such that a portion of said support plate beyond said seat cushion defines a storage area.

6. The improvement of claim 5, wherein said providing step further comprises said length of said roller segment being substantially greater than twice the bar distance.

7. The improvement of claim 5, wherein said providing step further comprises said at least one support element further including at least one trunk riser mounted upon and extending upward from said frame and a trunk support mounted upon said riser at a position above said frame.

8. The improvement of claim 7, wherein said providing step further comprises said at least one riser including a forward and a rearward pair of laterally spaced trunk risers, said rearward pair of risers being located rearward of said forward pair in the longitudinal direction, and wherein said trunk support is mounted for sliding movement along said risers, and further including means, selectively engageable at spaced vertical positions along said risers, for preventing downward movement of said trunk support plate.

9. The improvement of claim 8, wherein said providing step further comprises each of said risers being mounted to said frame by an associated trunk bracket, said trunk brackets allowing rotational movement of said risers with respect to said brackets about horizontal pivot axes substantially perpendicular to the longitudinal direction, and including means to selectively fix said risers against such rotational movement in a substantially vertical orientation, whereby said risers may be pivoted downward into a storage position in proximity to said frame.

10. The improvement of claim 9, wherein said providing step further comprises said pivot axes of said rearward trunk brackets being vertically higher than said pivot axes of said forward trunk brackets, whereby said trunk risers associated with said rearward trunk brackets may overly the remaining ones of said trunk brackets in proximity to said frame when in said storage position.

11. The improvement of claim 10, wherein said providing step further comprises said length of said roller segment being substantially greater than twice the bar distance.

12. The improvement of claim 9, wherein said providing step further comprises said at least one support element further including at least one head support riser extending upward from said frame and a head support mounted upon said head support riser at a position spaced vertically upward of said frame and longitudinally forward of said trunk support.

13. The improvement of claim 12, wherein said providing step further comprises said head support being mounted for vertical adjustment along said head support riser.

14. The improvement of claim 13, wherein said providing step further comprises a pair of laterally spaced head support brackets mounted upon said frame, and said at least one head support riser comprises a head support riser associated with each of said head support brackets, said head support brackets mounting said head support risers for rotational movement about axes substantially parallel to said pivot axes, and including means for selectively fixing said head support risers against said rotational movement in a substantially vertical orientation, whereby said head support risers may be pivoted into a storage position in proximity to said frame.

15. The improvement of claim 1, wherein said providing step further comprises said at least one support element further including at least one trunk riser mounted upon and extending upward from said frame and a trunk support mounted upon said riser at a position above said frame.

16. The improvement of claim 15, wherein said providing step further comprises said at least one riser including a forward and a rearward pair of laterally spaced trunk risers, said rearward pair of risers being located rearward of said forward pair in the longitudinal direction, and wherein said trunk support is mounted for sliding movement along said risers, and further including means, selectively engageable at spaced vertical positions along said risers, for preventing downward movement of said trunk support.

17. The improvement of claim 16, wherein said providing step further comprises each of said risers being mounted to said frame by an associated trunk bracket, said trunk brackets allowing rotational movement of said risers with respect to said brackets about horizontal pivot axes substantially perpendicular to the longitudinal direction, and including means to selectively fix said risers against such rotational movement in a substantially vertical orientation, whereby said risers may be pivoted downward into a storage position in proximity to said frame.

18. The improvement of claim 17, wherein said providing step further comprises said pivot axes of said rearward trunk brackets being vertically higher than said pivot axes of said forward trunk brackets, whereby said trunk risers associated with said rearward trunk brackets may overly the remaining ones of said trunk brackets in proximity to said frame when in said storage position.

19. The improvement of claim 17, wherein said providing step further comprises said at least one support element further including at least one head support riser extending upward from said frame and a head support selectively mounted upon said head support riser at a one of several possible positions spaced vertically upward of said frame and longitudinally forward of said trunk support.

20. The improvement of claim 19, wherein said providing step further comprises a pair of laterally spaced head support brackets mounted upon said frame, and said at least one head support riser comprises a head support riser associated with each of said head support brackets, said head support brackets mounting said head support risers for rotational movement about axes substantially parallel to said pivot axes, and including means for selectively fixing said head support risers against said rotational movement in a substantially vertical orientation, whereby said head support risers may be pivoted into a storage position in proximity to said frame.

* * * * *